US006419437B1

(12) United States Patent
Su

(10) Patent No.: US 6,419,437 B1
(45) Date of Patent: Jul. 16, 2002

(54) THERMAL BINDING MECHANISM

(76) Inventor: Chingsung Su, PO BOX 82-144, Taipei (TW)

( * ) Notice: Subject to any disclaimer, the term of this patent is extended or adjusted under 35 U.S.C. 154(b) by 0 days.

(21) Appl. No.: 09/755,127

(22) Filed: Jan. 8, 2001

(51) Int. Cl.[7] ..... B42C 9/00

(52) U.S. Cl. ..... 412/37; 156/908; 412/19; 412/902

(58) Field of Search ..... 412/37, 9, 18, 412/19, 33, 900, 902; 281/45; 156/216, 908

(56) References Cited

U.S. PATENT DOCUMENTS 4,678,386 A * 7/1987 Wiholm ..... 412/8
4,818,168 A * 4/1989 Battisti ..... 412/37
5,035,561 A * 7/1991 Loibl ..... 412/33
5,213,462 A * 5/1993 Loibl ..... 412/33
5,219,453 A * 6/1993 Furukawa et al. ..... 412/33
5,246,325 A * 9/1993 Morishige et al. ..... 412/11
5,306,047 A * 4/1994 Otake et al. ..... 281/21.1
5,775,864 A * 7/1998 Maes ..... 412/9

* cited by examiner

*Primary Examiner*—A. L. Wellington
*Assistant Examiner*—Monica Carter
(74) *Attorney, Agent, or Firm*—Leong C. LEI

(57) ABSTRACT

A thermal binding mechanism for thermal binding of a binding object having a thermal melted glue at one side includes: (a) a rectangular housing for holding with hands, having a recess defining a passage for the binding object to pass through; and (b) a clipping and heating mechanism mounted within the housing to heat and uniformly exert a force onto the binding object, having a first heat source located at the bottom portion of the path, and a pair of second heat source positioned at the two lateral sides of the recess, corresponding to the thermal melted glue of the binding object, thereby the binding object is located between the clipping and heating mechanism and the binding object is allowed to move relatively along the passage via the clipping and heating mechanism.

12 Claims, 6 Drawing Sheets

A-A

THERMAL BINDING MECHANISM

BACKGROUND OF THE INVENTION (a) Field of the Invention

The invention generally relates to a thermal binding mechanism, and in particular, relates to the thermal binding of a binding object using sealing leather with a paper layer to achieve the object of binding.

(b) Description of the Prior Art

U.S. Pat. Nos. 5,306,047, 5,246,325, 5,219,453, 5,213,462, 4,678,386 and 5,775,864 disclose thermal binding using various kinds of methods. These mechanisms essentially have a square shaped opened slot body at the top end and a heating unit is provided outside the slot body. In application, the covering leather and the paper are placed within the slot body and after sometime, it is taken out for solidification.

There are drawbacks and restrictions in view of the above thermal binding machine. First, the square slot body cannot be adjusted to suite the binding object of various thicknesses, and in particular, the length cannot be changed. Second, due to the size restriction of the square shaped slot body, the size of the machine has to be larger than the slot body, and therefore, the entire size becomes very large and cannot be easily portable and operated. In addition, the thermal melted glue distributed region is heated altogether and therefore the physical size cannot be reduced. Thus, the cost of production is high.

In order to solve the problem of fixed size of the square slot body being not changeable, a clipping mechanism is used to change the heating operation method. The heat emission element hidden within the clipping mechanism is substantially in contact with the covering leather and paper, and at the same time, the clipping mechanism moves in relation to the combination of the covering leather and the paper so as to achieve binding. By means of active moving operation of the clipping mechanism, the entire binding structure is simplified and various thickness and length of object can be bonded together.

SUMMARY OF THE INVENTION

It is therefore an object of the invention to provide a thermal binding mechanism, wherein a heat source and binding object moves relatively so proceed with the thermal binding operation.

Yet another object of the present invention is to provide a thermal binding mechanism comprising a clipping mechanism mounted with a heating element, wherein a clipping mechanism is used to guide and support the binding object so that the clipping mechanism and the binding object are in contact slightly and move relatively to proceed with the binding operation.

An aspect of the present invention is to provide a thermal binding mechanism for thermal binding of a binding object having a thermal melted glue at one side comprising (a) a rectangular housing for holding with hands, having a recess defining a passage for the binding object to pass through; and (b) a clipping and heating mechanism mounted within the housing to heat and uniformly exert a force onto the binding object, having a first heat source located at the bottom portion of the path, and a pair of second heat source positioned at the two lateral sides of the recess, corresponding to the thermal melted glue of the binding object, whereby the binding object is located between the clipping and heating mechanism and the binding object is allowed to move relatively along the passage via the clipping and heating mechanism The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
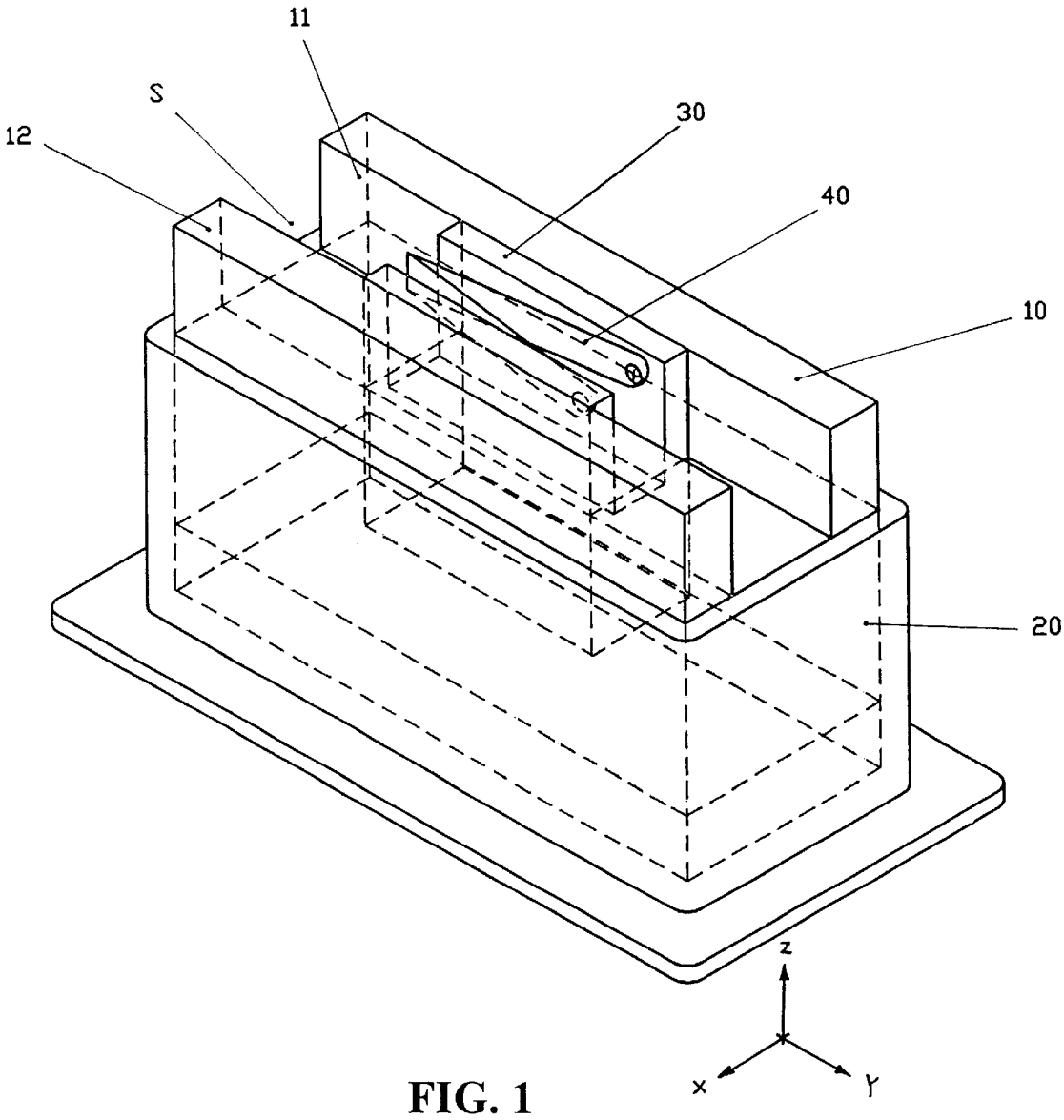
FIG. 1 is a perspective view of the preferred embodiment of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
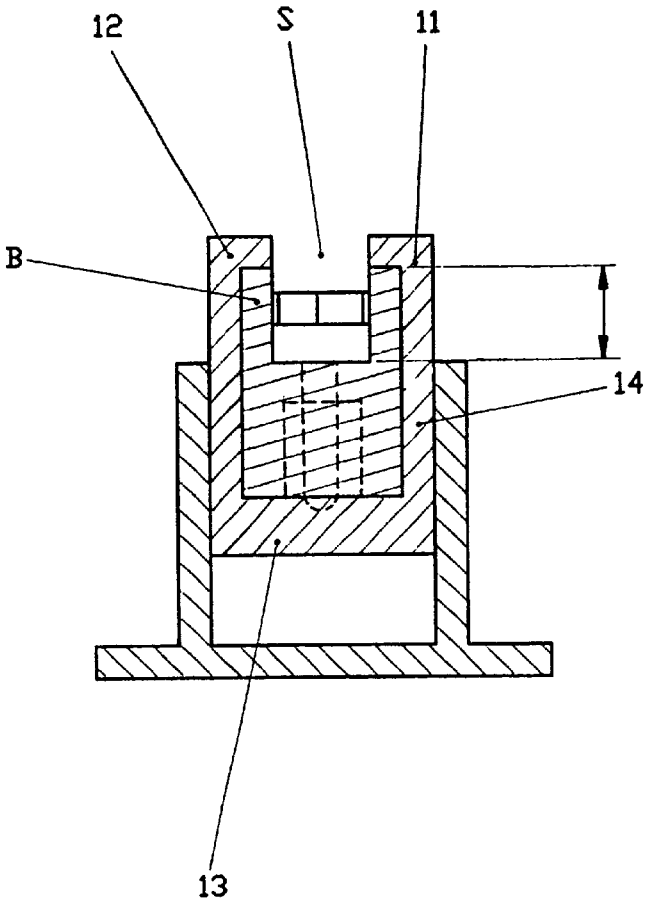
FIGS. 2 and 3 show the sectional views of the essential elements of the preferred embodiment of the present invention.
Figure 2:
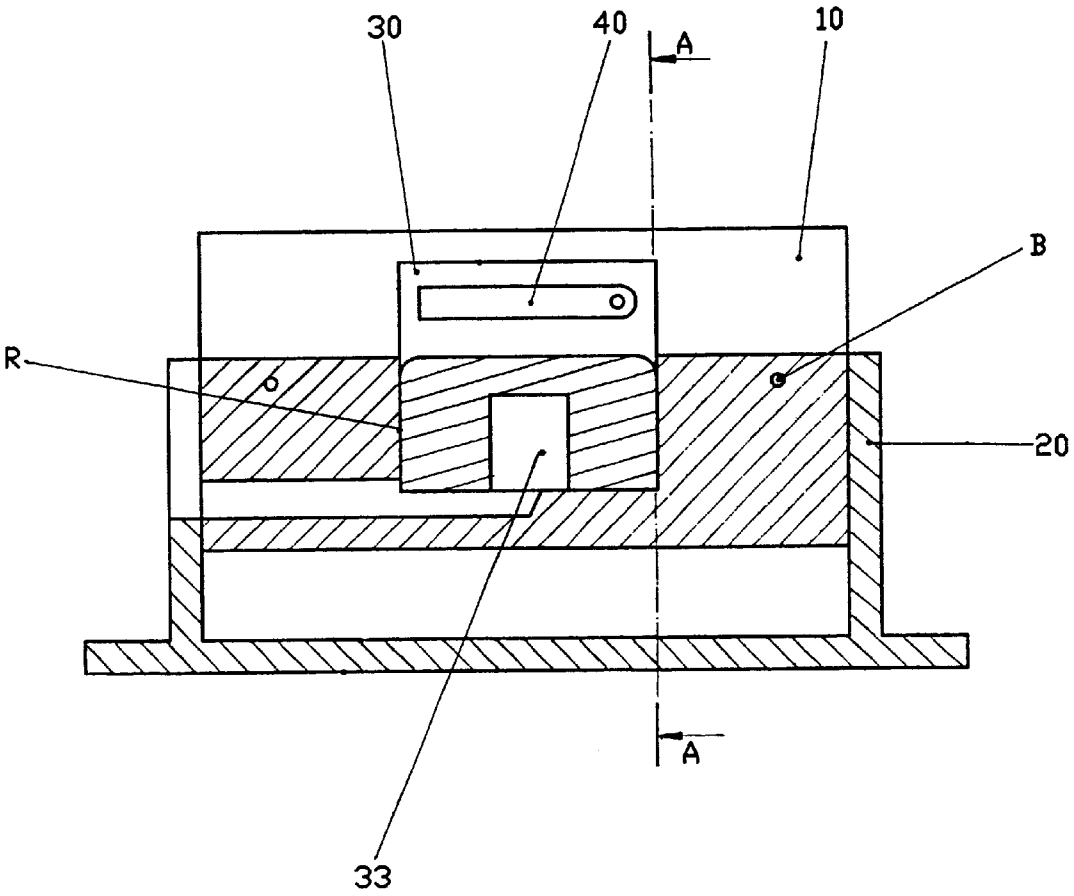

As seen in FIGS. 1 to 3, there is shown a preferred embodiment of the thermal binding mechanism comprising a housing 10 of rectangular shape for holding with hands, and a first heat source 30 located within the housing, having a contact surface and a surface contact (X-Y plane of FIG. 1) of a binding object, and a pair of second heat source 40 extended lateral side to provide a vertical surface contact (Y-Z plane) such that the first heat source and the second heat source form into a heating region with two axis which assist the rapid proceeding of heat transfer to increase the melting of the melted glue hidden in the binding object. I.e., the relative linear action of the binding object and heat source. The preferred embodiment further comprises a seat body 20, which is detachably connected to the housing. The seat body is located in a position corresponding to another free surface of the recess of the housing such that the seat body faces downward and can be placed onto a support surface. The recess of the housing faces upward to accept the binding object being slidably displaced linearly. The seat body 20 can also be located at the other two surfaces and the configuration is thus changed. The seat body must appropriately balance when in operation.

In the first preferred embodiment, the heat source at the housing is used to form a U-shaped heating surface such that the binding object is substantially in contact with the U-shaped surface and linearly moves along the recess of the housing.

A second preferred embodiment employs a support housing such that the U-shaped heating surface is exposed so that the operator can place the binding object to the recess and in contact with the U-shaped surface and moves relatively along the recess. The two preferred embodiment provide a uniform and rapid heat source, which assists transient phenomenon of heat transfer or reduces time constant of the time response such that the relative motion of the binding machine with the binding object can be increased. The recess of the housing allows the user without operating a clipping force and the clipping force can be provided by the relative distance of the second heat source so as to reduce the unevenness of tension.

Referring to FIGS. 1 to 3, the housing 10 can be formed from two symmetrical semi-housings fastened to each other with screw B or engaging structure. An engaging section R within the housing is used to position the heat source. In the preferred embodiment the heat source can be made into rectangular shape. The housing 20, viewing in cross-section, has a first fork body 11 and a second fork body 12 and a slot is formed by the two bodies, and the slot defines a passage for the binding object. The other end of the housing is provided with a connection recess 13 and is corresponding to the seat body 20. The side surface of the housing is meant for holding at a holding portion 14 to control the moving of the binding object. In accordance with the present invention, the heat source is made from a metallic or a heat conduction material and the binding object has a low frictional force at the substantially contact region to facilitate moving so that the surface of the binding object is not polluted or damaged. In accordance with the present invention, the first heat source is provided by an electrical heat unit 33, for instance, 10 W positive temperature coefficient (PTC).

Figure 4:
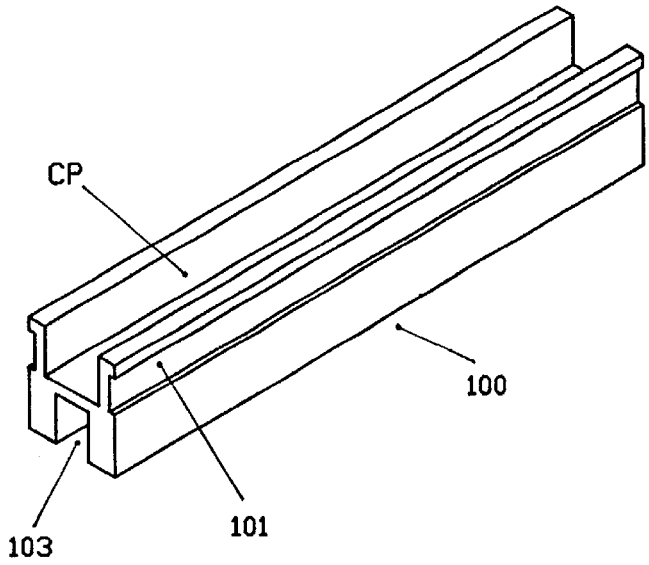
FIGS. 4, 4A, 5, 5A, 6 and 7 show the different types of heat source structure in accordance with the present invention.
Figure 4A:
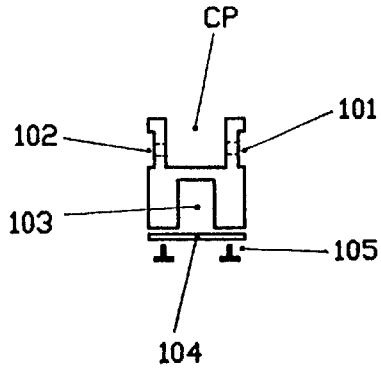
Figure 5:
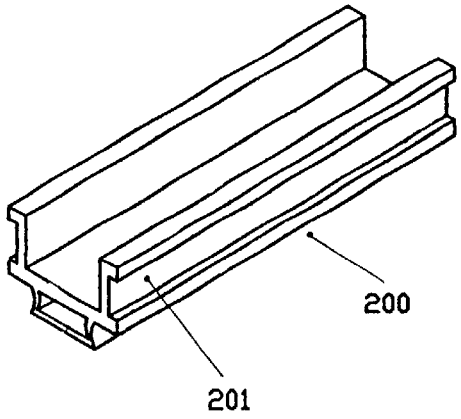
Figure 5A:
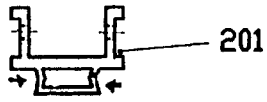

Referring to FIGS. 4 and 4A, PTC heat source structure is denoted by reference number 100, and the lower section of the clipping space 103 is provided with a press board 104 to press again the PTC heat emission body and a screw 105 is used to lock the PTC so as to provide a clipping force. Thus, the heat energy can be appropriately transferred to the entire heat source structure.

Figure 6:
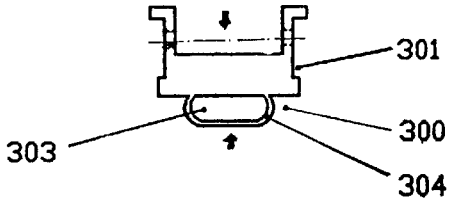
Figure 7:
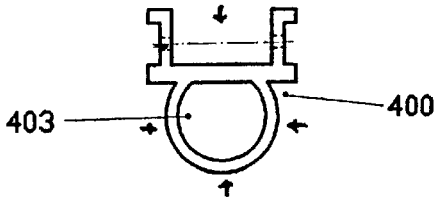

Referring to FIGS. 5, 5A, 6 and 7, there is shown different types of closed type heat source and are denoted by 200, 300, 400. FIG. 6 shows a lateral wall 304 located at different clipping space 303. FIG. 7 shows a structure, which facilitates application of force. The clipping space 403 is a circular cross-sectional view.

In accordance with the present invention, the second heat source 40 can be formed integrally or detachably connected, or separated from the first heat source and form into a side clipping and heating mechanism The second heat source can be a pair of plate bodies having one end corresponding to a larger open end 41, 41'. As shown in FIG. 8, inlet D1 is the largest thickness of the binding object. The other free ends 42, 42' are closed to each other to form an outlet D2. As the plate body has elasticity, the plate body is forced to open when the binding object is passed to the inlet D1 and formed into a clipping force. The second heat source 40 and the first heat source are formed integrally.

Figure 8B:
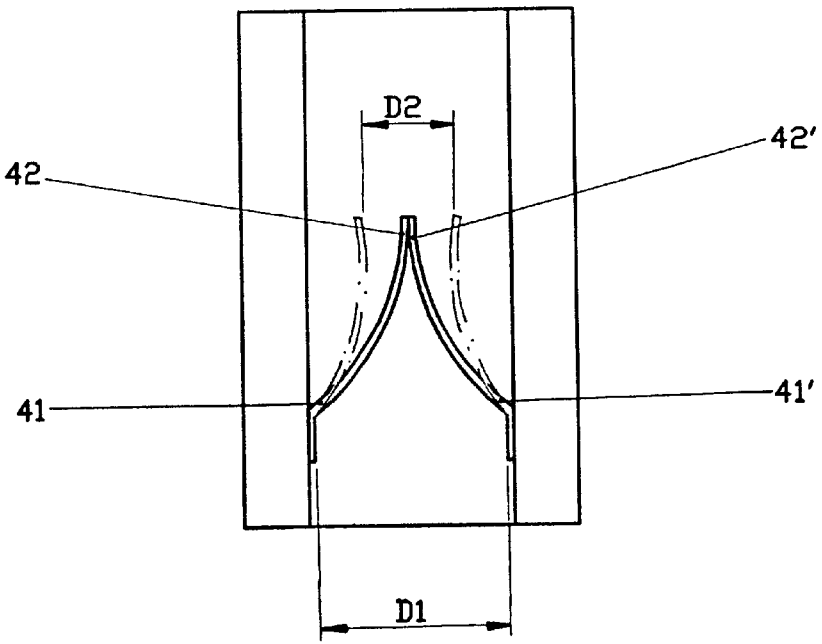
FIGS. 8A, 8B and 8C are the second heat source or the elastic support suitably used in FIGS. 2 to 5.
Figure 8A:
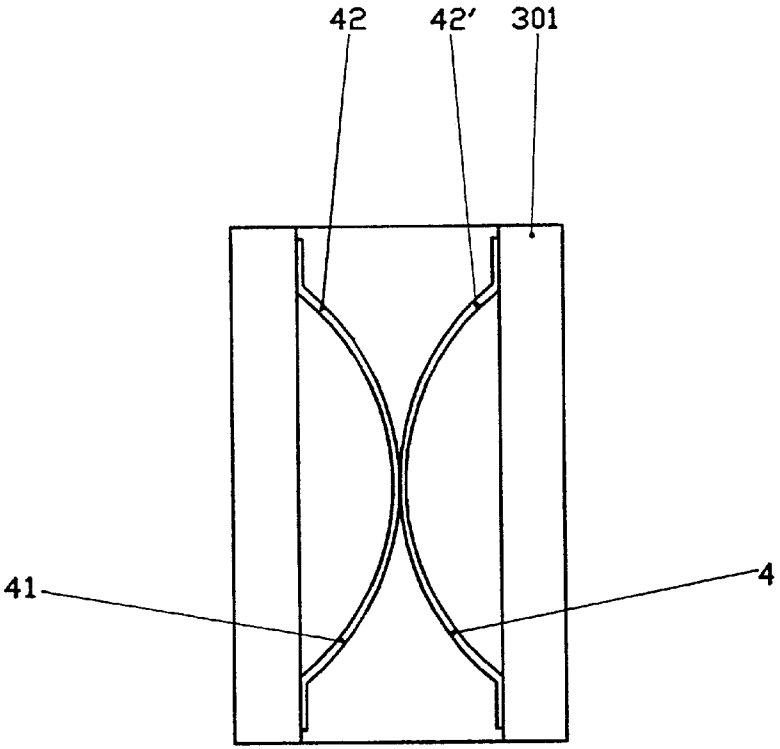
Figure 8C:
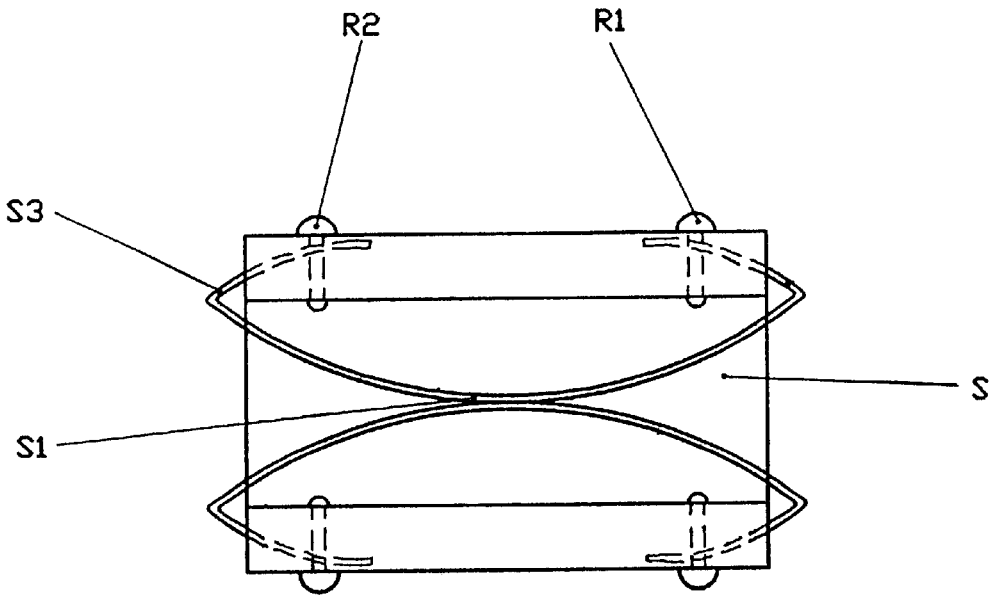
Figure 9:
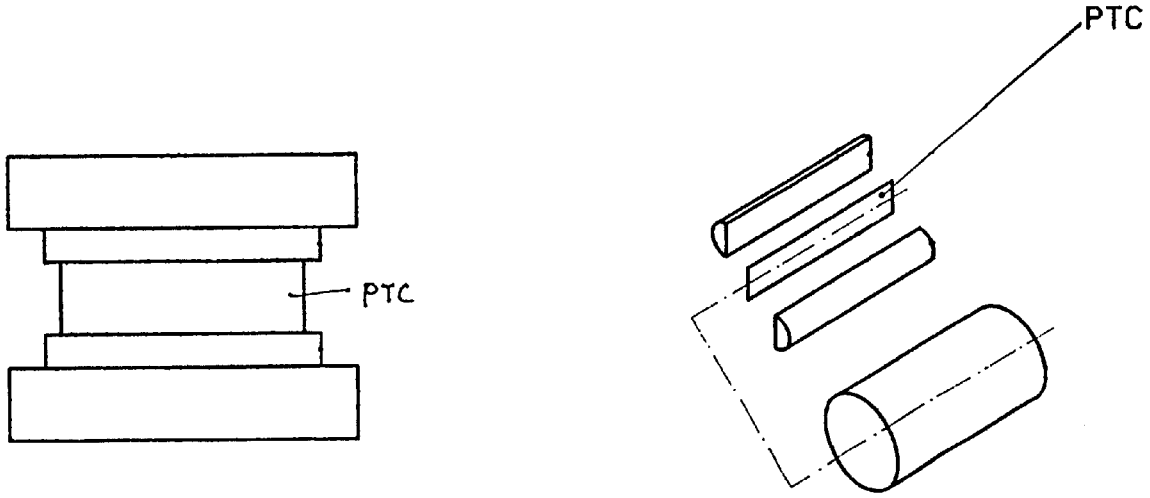
FIG. 9 shows the basic combination of the PIC heat emission body.

Referring to FIGS. 8A, 8B and 8C, the shape of the passage CP is a rectangular recess and a pair of symmetrical second heat source and elastic plate is used for clipping. As shown in the figure, the elastic plate S is arch-shaped with symmetrical arcs and the center arch-shaped section S1 are corresponding to slightly contact the two free ends S3 forming a hooking section surrounding the heat source, and positioned at the positioning recesses 101, 201, 301 and are fixed by rivets R1, R2.

Figure 10:
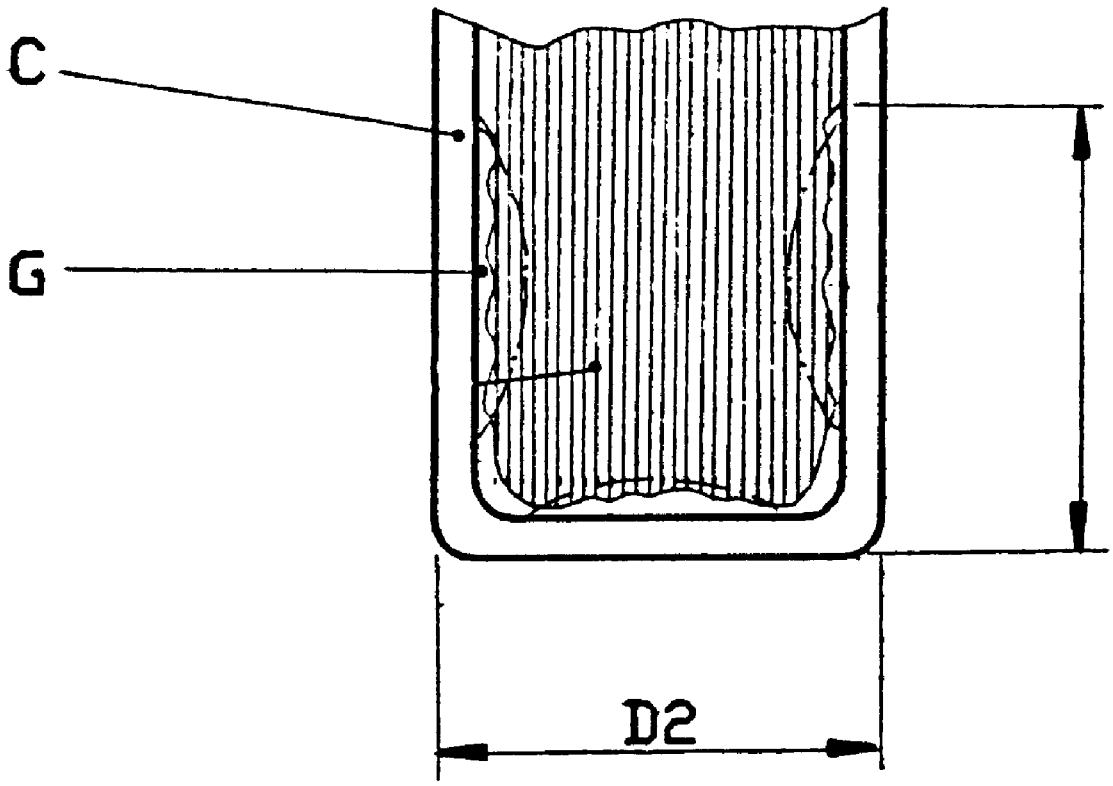
FIG. 10 shows schematically the binding object of the present invention.

The operation of the present invention can be understood from FIG. 10. The binding object is a sealing leather C being bent to form a bending structure. Typically, the thickness is 0.3 mm and the inner edge of the sealing leather C is provided with a thermal melted glue layer G that is melted at 100 degree C. and is a thermosetting material. The paper layer and the sealing leather C are connected and the glue layer G is then melted and penetrated the paper and solidified. Normally, the number of paper P is changed to increase the thickness of adhesion.

In accordance with the present invention, the advantages are as follows:

(1) The seat body 20 can be operated differently; therefore, the operation of the mechanism can be operated actively or passively.

(2) the U-shaped clipping and heating mechanism provides even heating and the rate of heat transfer is improved.

(3) The U-shaped clipping and heating mechanism is simplified and the entire mechanism can be reduced in size.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A thermal binding mechanism for thermal binding of a binding object having a thermal melted glue at one side comprising:

a rectangular housing for holding with hands, having a recess defining a passage for the binding object to pass through; and a clipping and heating mechanism mounted within the housing to heat and uniformly exert a force onto the binding object, having a first heat source located at the bottom portion of a path, and a pair of second heat sources positioned at two lateral sides of the recess, corresponding to the thermal melted glue of the binding object;

the second heat sources being detachably connected to the first heat source;

whereby the binding object is located between the clipping and heating mechanism and the binding object is allowed to move relatively along the passage via the clipping and heating mechanism.

2. The thermal binding mechanism for thermal binding of a binding object as set forth in claim 1, wherein the second heat sources are heated by the heat energy independent of the first heat source.

3. The thermal binding mechanism for thermal binding of a binding object as set forth in claim 1, wherein the second heat sources are mutually corresponding to each other and one end thereof is defined as the inlet and the other end is defined as the outlet for the binding object moving along the passage.

4. The thermal binding mechanism for thermal binding of a binding object as set forth in claim 1, wherein the second heat sources are symmetrical arch-shaped structure and the middle of the arch-shaped structure is slightly in contact and the two free ends are formed into two hooking section surrounded the external side of the heat source body.

5. The thermal binding mechanism for thermal binding of a binding object as set forth in claim 1, wherein the bottom surface of the seat body has a high coefficient of frictional force.

6. The thermal binding mechanism for thermal binding of a binding object as set forth in claim 4, wherein the bottom surface of the seat body at least a portion is mounted with a buffer element.

7. The thermal binding mechanism for thermal binding of a binding object as set forth in claim 4, wherein the buffer element is a rubber pad or ring.

8. The thermal binding mechanism for thermal binding of a binding object as set forth in claim 1, wherein the heat source of the first heat energy is from gas fuel.

9. The thermal binding mechanism for thermal binding of a binding object as set forth in claim 8, wherein the heat source body, corresponding to the moving passage, is provided with an open adaptation space to accommodate a PTC heat emission body, and a press board is used to cover the adaptation space.

10. The thermal binding mechanism for thermal binding of a binding object as set forth in claim 8, wherein the heat source body, corresponding to the moving passage, is provided with a closed space to accommodate a PTC heat emission body and is allowed to deform to clip the heat emission body.

11. The thermal binding mechanism for thermal binding of a binding object as set forth in claim 10, wherein the cross-sectional area of the closed space is a rectangular shape.

12. The thermal binding mechanism for thermal binding of a binding object as set forth in claim 11, wherein the cross-sectional area of the closed space is circular shape.

* * * * *